US005722334A

United States Patent [19]

Martin et al.

[11] Patent Number: 5,722,334

[45] Date of Patent: Mar. 3, 1998

[54] FIRE GRATE, IN PARTICULAR FOR WASTE INCINERATORS

[75] Inventors: Walter Josef Martin; Johannes Martin, both of Munich, Germany

[73] Assignee: Martin GmbH fur umwelt- und Energietechnik, Germany

[21] Appl. No.: 800,583

[22] Filed: Feb. 18, 1997

[30] Foreign Application Priority Data

Feb. 19, 1996 [DE] Germany ..... 196 06 107.5

[51] Int. Cl.[6] ..... F23H 7/08; F23H 7/14

[52] U.S. Cl. ..... 110/281; 110/101 R; 126/174; 126/175

[58] Field of Search ..... 110/281, 286, 110/289, 290, 267, 268, 327, 328, 330, 101 R; 126/168, 167, 174, 175

[56] References Cited

U.S. PATENT DOCUMENTS

| | | | |
|---|---|---|---|
| 1,565,017 | 12/1925 | Lower | 110/101 R |
| 2,356,144 | 8/1944 | Beers | 110/330 |
| 4,328,786 | 5/1982 | Owen | 126/174 |
| 4,418,816 | 12/1983 | Kropp | 198/773 |
| 5,178,128 | 1/1993 | Krieger | 126/175 |
| 5,205,100 | 4/1993 | Lecointre | 52/573.1 |
| 5,377,663 | 1/1995 | Cole et al. | 126/152 B |

FOREIGN PATENT DOCUMENTS

| | | | |
|---|---|---|---|
| 39 07 463 C1 | 3/1990 | Germany | 126/174 |
| 4105331C1 | 4/1992 | Germany . | |

*Primary Examiner*—James C. Yeung
*Assistant Examiner*—Ljiljana V. Ciric
*Attorney, Agent, or Firm*—Wood, Herron & Evans L.L.P.

[57] ABSTRACT

A fire grate has tensioning devices (3) inserted in recesses (2) of an oven wall (1), with each device acting upon one grate side plate. The tensioning device (3) includes a cylinder (4) inserted into the oven wall, a hollow piston (7) guided therein and a spring (26), which can be adjusted in its tension. The grate side plate has a carrying plate (12) directly fastened to the piston bottom (10) with a grate border plate (13) suspended, or hanging, on the carrying plate (12). The piston (7) has diameter and length dimensions such that it can support and guide the grate side plate without further guiding devices. Neighboring pistons (7) are connected flexibly to each other by guiding bars (36), so that the pistons (7) can influence each other reciprocally. An upper edge of the grate side plate, particularly the grate border plate (13), has a flange (17) extending toward the oven wall. The flange (17) sealingly engages an elastical seal (19), fastened onto the oven wall. An additional covering ledge (21) covers the flange (17) and includes a shaped part or angle (22) which bounds a hollow space (23) between these two parts, just like a labyrinth seal.

13 Claims, 3 Drawing Sheets

FIRE GRATE, IN PARTICULAR FOR WASTE INCINERATORS

BACKGROUND OF THE INVENTION

The invention relates to a fire grate, in particular for waste incinerators, with partly overlapping rows of grate bars, wherein along the longitudinal axis the grate bar rows are alternately fixed and movable and wherein the grate bar rows are bordered, or bounded, by grate side plates. The grate side plates are movable transverse to their longitudinal axes and can be pressed towards the grate bar rows by tensioning devices, which are held in the oven wall and which are shaped as piston-cylinder-units.

With one known combustion grate of this kind (DE-41 05 331 C1), the grate side plates are guided at the upper and lower edges by grate bar shields, particularly shields which appear u-shaped, and the grate bar shields are fastened to grate bar supports. Hydraulic cylinders serve as tensioning devices and are provided at both ends of the grate side plates, so that each hydraulic unit pushes both ends of adjacent grate side plates. Along their longitudinal axis the stationary grate bars secure directly to the grate side plates. For each of the longitudinally movable grate bars a glide piece is provided, guided in the grate side plates onto which an additional hydraulic-cylinder-unit acts, which extends freely through the grate side plate with its ram. Relatively high expense is incurred, in order to equalize the different conditions that may arise between the movable and the fixed grate bar rows. One further disadvantage of this design relates to the narrow guiding of the grate side plates in the u-shape guidings, in particular under the influence of dust, which is unavoidable in a combustion chamber. In this environment, dust accumulation may cause tilting and jamming, thereby adversely affecting the use of the grate.

SUMMARY OF THE INVENTION

The objective of the invention is to design a grate characterized according to claim 1, achieving a relatively trouble-free use of the grate and the tensioning devices including the grate side plates, with relatively low constructional expense.

The invention reaches this objective by starting with a grate of the above-mentioned kind, by rigidly securing a piston of the tensioning device onto each grate side plate to support and guide the grate guide plate only with the piston, and the tensioning device includes a cylinder open towards the combustion chamber with a hollow-piston guided therein. The piston is charged by a spring element supported by the cylinder's bottom, and the piston is rigidly secured to the grate side plate by a piston bottom which is sealingly guided by a "piston-sleeve" located within the cylinder.

This design improves over the prior art, or current state of the art, because no further guidings for the grate side plates are necessary, since the guiding and supporting tasks are provided by the tensioning device itself, to which the grate side plates are in each case rigidly secured. Prior problems related to tilting and jamming of the grates are thus avoided. The constructional expense is also minimized, because no additional guidings for the grate side plates are necessary.

In order to have the piston of the tensioning device perform the guiding task in a very reliable way, another aspect of the invention contemplates providing the "piston-sleeve" with a length longer than the depth of the cylinder. With this feature, during all stroke movements which the tensioning device has to carry out during operation of the grate, there is at all times a sufficient guiding length of the piston inside the cylinder.

According to a further aspect of the invention, which is advantageous for proper guiding of the pistons and thereby for proper guiding, i.e., without sticking, of the grate side plate, the diameter of the pistons (the pistons are preferably circular in cross section), is larger than one half of the height of the grate side plate. Due to the large dimension of the cylinders and the pistons of the tensioning device, which is at the same time the guiding device for the grate side plate, a proper guiding of the grate side plate is guaranteed at a low constructional expense. This proper guiding is assured even during technical faults in the use of the grate, which may result from objects entering in between neighboring grate bars.

According to still another advantageous aspect of the invention, neighboring or adjacent pistons are connected to each other by guiding bars, which flexibly connect the free ends of neighboring pistons. These guiding bars not only help to avoid rolling or twisting of the pistons, they also serve to influence neighboring pistons of neighboring tensioning devices in a way such that one piston takes along the neighboring piston up to a certain extent. Thereby a connection is made between the separate tensioning devices just like a limb chain, which has effects on each of the neighboring pistons, so that like a wavy line the grate side plates can adapt to the different stretch conditions of the grate bar rows, which lay one on top of the other like roof tiles. By doing so, there is no need for additional tensioning devices as required by conventional state of the art waste incinerator tensioning devices, which reach through the grate side plate to act directly upon the movable grate bar rows and which are generally very expensive. Thus, this invention avoids the technical expense of these known grate designs.

According to yet another aspect of the invention, each of the joint connections between the pistons and the guiding bar has a joint bolt which is oriented at a right angle to the longitudinal axis or the piston, and which extends through the guiding bar and is retained by spaced support tongues which are rigidly secured to the piston and which hold the guiding bar therebetween. Thereby a robust and simple constructive connection between neighboring pistons is made, which allows for reciprocal or mutual compensation of different stretch states of grate bar rows.

Due to the fact that there are no additional guiding devices needed (particularly guiding devices of the prior art, which are constructionally lavish and require a relatively large amount of space), the invention contemplates a further design advantage which relates to the fact that the cylinders are fastened concisely to the bottom of an oven wall recess, setback, having a depth measurement such that the grate side plates secured to the open ends of the cylinder are aligned with the oven wall at operating temperature of the grate bars. Additional space to provide additional guiding devices for the grate side plates is not necessary, so that there is no need for extra designing expense of the oven wall due to the reduced space requirements. Such additional amounts of space were required, however, by conventional guiding devices.

In order to increase the heat resistance of the grate side plates, which obviously can be created as simple plates, the invention contemplates designing the grate side plates with double walls and a carrying or support plate connected to the piston, as well as a grate border plate depending therefrom made of high temperature resisting material and having backside support ribs (on the side of the carrying plate), extending transverse to the longitudinal axis of the grate border plate. With this design the grate side plate can have a smaller size than usual (compared to the prior art conventional side plates), because it is covered by the grate border plate which has larger height and length dimensions.

Preferably, the grate border plate comprises several smaller plate parts, or portions, arranged in longitudinal alignment with some amount of spacing therebetween, along the longitudinal direction of the carrying plate, the total length of the plate portions corresponding to the length of the carrying plate.

Still another advantageous aspect of the invention relates to the fact that each of the grate side plates has a flange along its upper edge extending toward the oven wall. The flange is covered by a covering ledge secured to the oven wall, preferably with some clearance space therebetween, i.e., a relatively loose tolerance. Thereby a certain protection is achieved against ingress of dust and other parts, which could otherwise enter behind the grate side plates.

To improve this barrier, or ingress prevention, according to a further advantageous aspect of the invention an elastically yielding seal is located between the free edge of the flange of the grate side plate, particularly the free edge of the grate border plate, and the oven wall, preferably with the seal fastened to the oven wall. Such a seal consists of mineral components, in a known way, which are accordingly heat resistant and sufficiently elastic to accommodate the movement of the grate side plate, particularly the grate border plate, and to provide an effective seal.

A further improvement of the seal relates to the use of a bridge extending longitudinally along the backside of the grate side plate, particularly the carrying plate, which extends sealingly into a horizontal groove formed in the seal.

In order to protect the seal from excessive stress due to dust, a further design of the invention contemplates including a hollow space within the covering ledge, and opening toward the flange. This space may be formed by the integral shape of the covering ledge, whereby a kind of a labyrinth sealing effect is created between the flange of the grate side plate, particularly the grate border plate, and the covering ledge, thereby providing a void space for any entering air and airborne dust, so that the dust penetration between the upper edge of the grate side plate, particularly the grate border plate, and the covering ledge is mostly prevented. This reduces dust exposure for the seal thereby enabling it to perform its sealing function for a longer period of time.

In order to adjust the tensioning device to the respective circumstances, or conditions, according to still another aspect of the invention the spring element may be adjustable in its tension.

The invention will be more readily understood in view of the following drawings and detailed description, which are exemplary in nature. The drawings show:

DETAILED DESCRIPTION OF THE DRAWINGS

Figure 3:
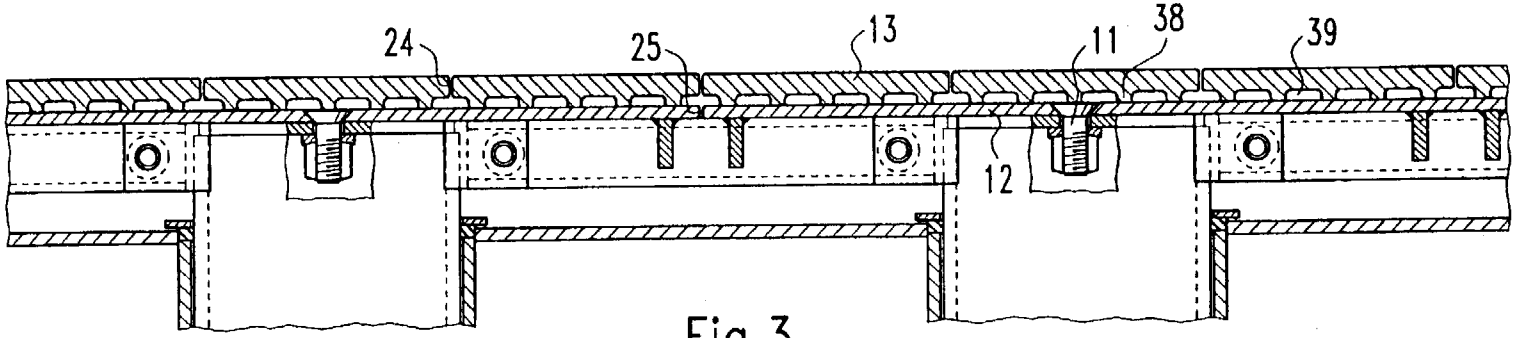
FIG. 3: A sectional view according the lines III—III in FIG. 2.

Reference numeral [1] refers to an oven wall having a setback, or recess [2] at the height of the grate, into which several tensioning devices are arranged, the tensioning device referred to generally by reference numeral [3]. Each tensioning device [3] includes an open cylinder [4] which opens towards a combustion chamber, and which is fastened securely with one open end onto a bottom or outermost portion [5] of the recess [2], for example by a welding seal [6]. Within the cylinder [4] a hollow piston [7] with its piston shirt [8], is guided and sealed by a seal [9] to prevent dust from entering the interior of the cylinder [4]. The piston sleeve [8] is designed longer than the depth of the cylinder [4], so that it is guided sufficiently at all times during all stroke movements. At the bottom [10] of the piston [7] there is a carrying, or support, plate [12] solidly fastened by screws [11], onto which a group of grate border plates, or plate portions [13] (FIG. 3) depend to provide heat protection. The grate border plates have bowed upper ends [14] and ribs [15] extending therefrom with depending grooves [16]. The grate border plate [13] also has a flange [17] on its upper edge, extending towards the oven wall, and a free end [18] thereof engages an elastic seal [19], which is held to the bottom [5] of the recess [2] of the oven wall [1], by a support [20]. A covering ledge [21] is also secured to the oven wall above the flange [17] of the grate border plate [13]. The ledge [21] is formed so as to have an inverted V-shaped bend [22] and a hollow space [23] therebelow created by the shape [22]. The space [23] defined by ledge [21] is mostly covered by the flange [17], so that a void or relaxation space is created therebetween, just like a labyrinth seal. In the shown example the grate side plate comprises the carrying plate [12] and the grate border plate [13]. If both components are designed as a single combined structure, the combined grate side plate has the same outer appearance as the grate border plate [13].

The grate border plates [13], which are hung on the carrying plate [12], one alongside the other with small gaps [24] therebetween, have a total length which corresponds to the length of the carrying plate [12], so that there is no covering between adjacently located carrying plates [12] at the gap [25]. Thereby each of the carrying plates [12] and the grate border plates [13] attached thereto can move together transverse to the longitudinal direction of the grate, due to extension of the grate caused by the action of the tensioning device [3].

In order to operate the tensioning device [3] to cause this movement, a compression spring [26] is provided inside the hollow piston [7], with one end thereof secured to a bottom [10] of the piston [7] and the other end secured to a backplate [27] which is shaped to conform to the inner diameter of the hollow piston [7]. The backplate [27] is seated at the end of an adjusting screw [28], which is screwed into a nut [30] secured to the bottom [29] of the cylinder [4] and which is secured by a counternut [31]. On its outer end, i.e., outside of the cylinder [4] and outside the chamber, the adjusting screw [28] has a head-shaped handle [32] with a through-bore [33], into which an accordingly thick bar can be inserted in order to twist the adjusting screw [28] and to adjust the tension of the pressure spring [26].

The piston [7] extends out of the cylinder [4] a distance such that the grate border plates [13] and essentially aligned, or lined up with, the oven wall [1]. Within the free space, which is formed by the recess [2], the neighboring pistons [7] are flexibly connected by guiding bars [34]. Spaced support tongues [35] are fastened, for example by welding, onto opposite sides of the piston sleeve [8] of each piston [7]. The spaced support tongues [35] also hold therebetween the guiding bar [34], and a joint connection is made via a joint bolt [36] which extends through aligned holes in the spaced support tongues [35] and the guiding bar [34]. Due to the fact that the pistons [7] of neighboring tensioning devices [3] are flexibly connected by the guiding bars [34], a twisting of the pistons [7] in their respective cylinders [4] and a twisting of the carrying plates [12] is avoided. Also, the mutual influence of tensioning devices [3] is achieved by these guiding bars [34], so that different expansions of grate bar rows following, or adjacent, one another can be compensated. These different expansion conditions can be caused on the one hand by the different heat burdens of the grate bars, or by pieces of slag, which sometimes enter in between the grate bars.

Each carrying plate [12] is attached to one tensioning device [3], by which the carrying plate is supported and guided. In order to achieve proper guiding, the piston [7] and the respective cylinder [4] have a diameter as large as possible, with the diameter of the piston being almost as great as the height of the carrying plate [12]. The length of the piston sleeve [8] also promotes a stable guiding of the piston [7] and thereby of the carrying plate [12]. Each carrying plate [12] can either be attached to a single grate bar row or the carrying plates can also have a greater length, so that they spread in part over the following grate bar row or even over several grate bar rows. In order to enable the carrying plates to resist the recurring forces, bridges [37] are secured to the backsides thereof, for example by welding. To increase the stability of the grate border plate [13], ribs [38] (FIG. 3) are provided on the backsides, which run transverse to the longitudinal direction of the carrying plate [12]. Due to the spacing between these ribs [38], in the vertical direction hollow spaces [39] are created, into which fresh air can enter from the lower area of the gap that is created by the recess [2], in order to cool the grate border plates and/or the carrying plate. Due to the seal [19], this upwardly flowing cooling air coming out of the lower air box is not able to flow around the grate laterally. For this reason, the lower air box causes practically no dust wear or strain, and the seal [9] is sufficient enough to keep dust from entering into the cylinder [4].

Figure 1:
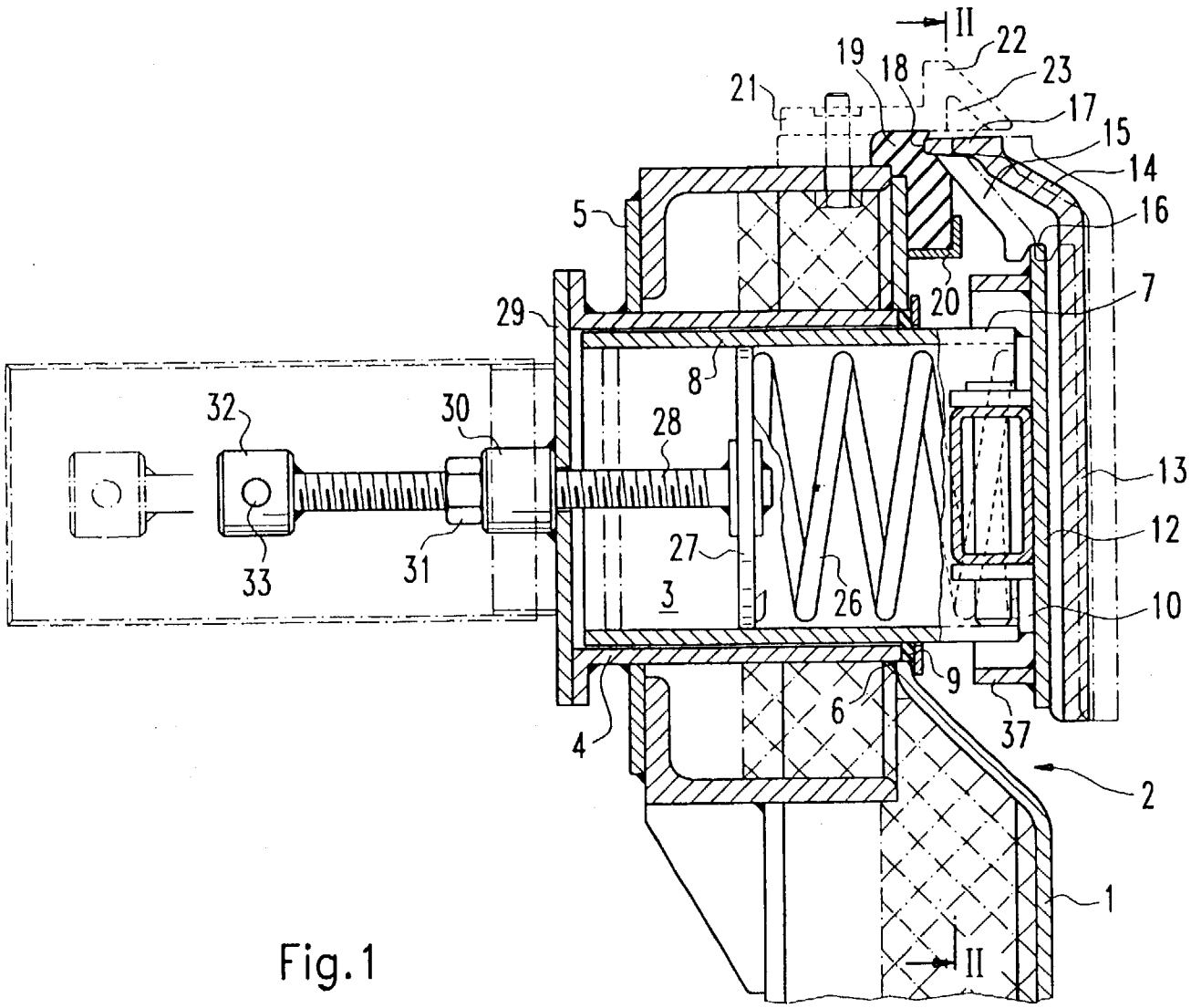
FIG. 1: A vertical section through a tensioning device with carrying plate and grate border plate.
Figure 2:
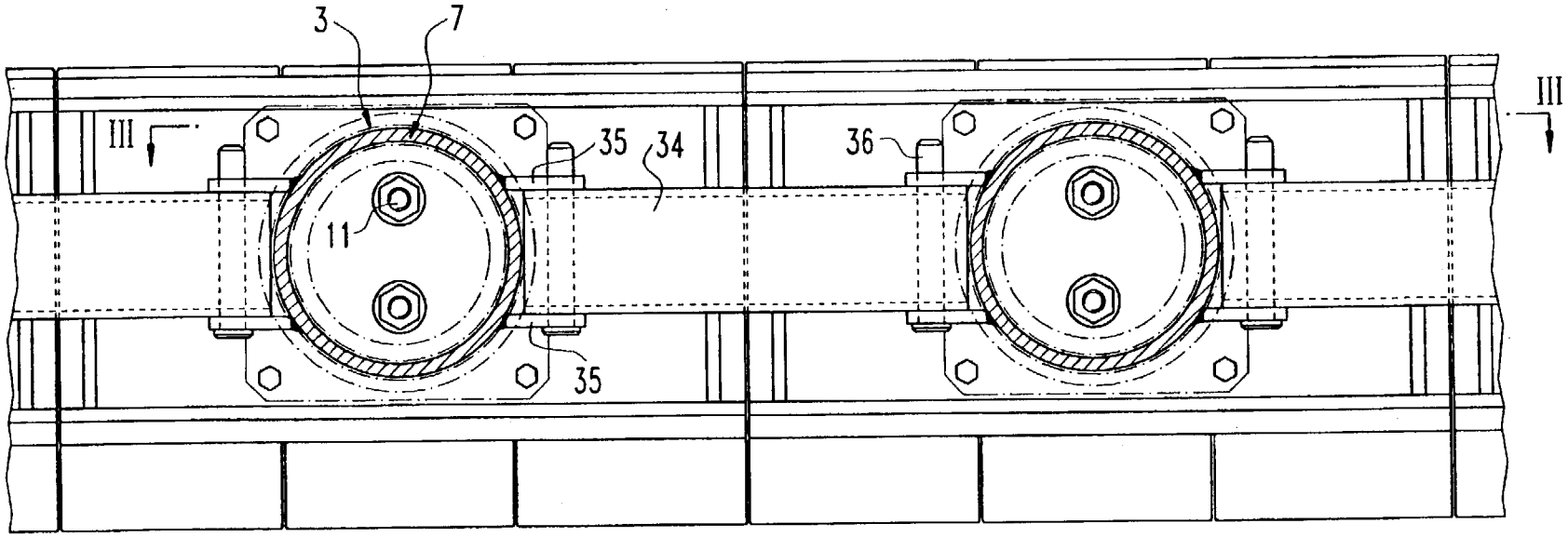
FIG. 2: A view in the direction of the section lines II—II in FIG. 1.
Figure 4:
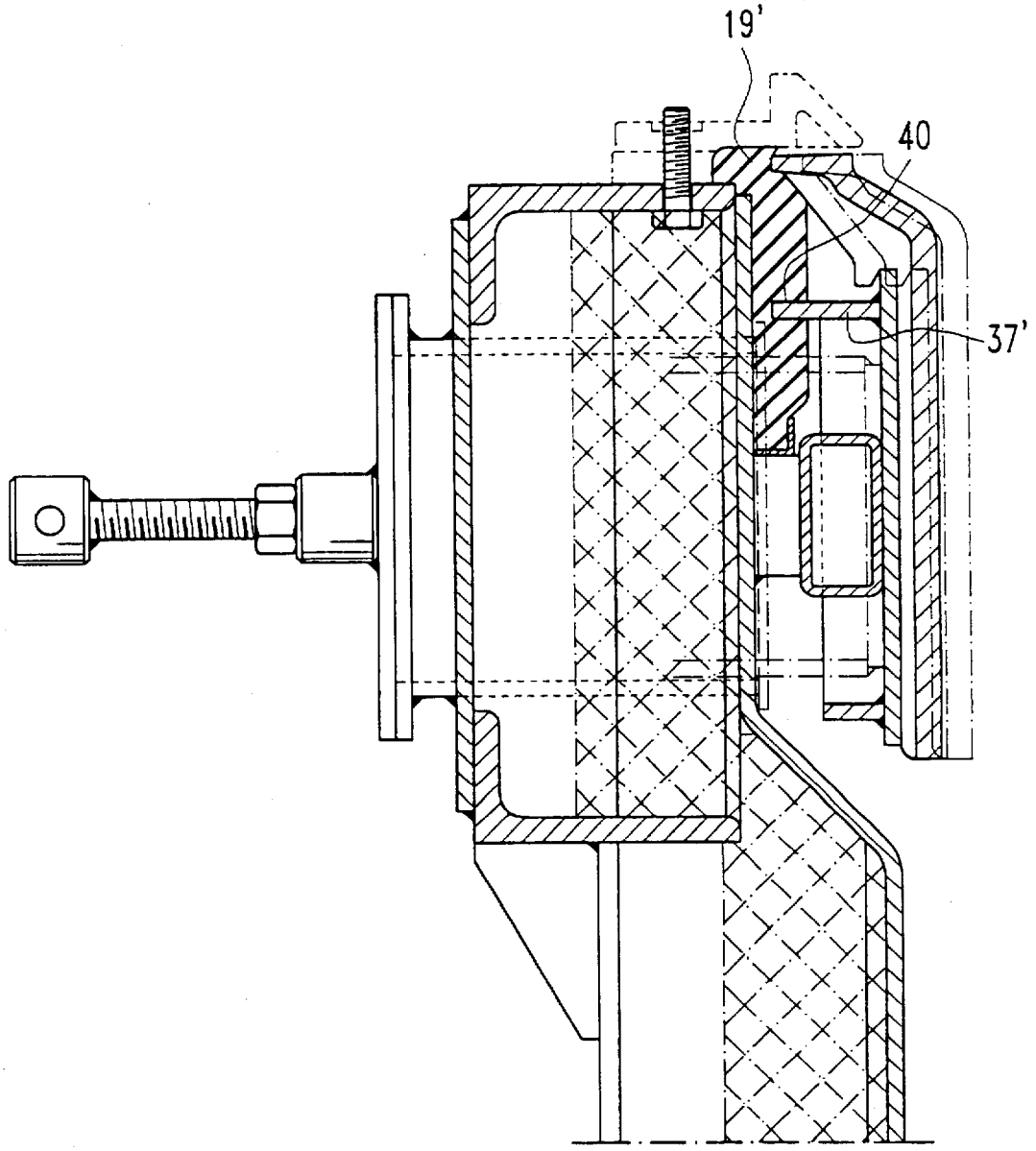
FIG. 4: A vertical section, similar to FIG. 1, of another embodiment of the invention.

FIG. 4 shows a variation of the seal between the grate border plates and the oven wall. According to this variation, the seal [19'] has a greater vertical dimension and also has a horizontal groove [40], into which a lengthened bridge [37'] extends to achieve additional sealing. Except for this difference, the design shown in FIG. 4 is identical with the design referring to FIGS. 1, 2, 3.

We claim:

1. Fire grate, in particular for use in a waste incinerator having a combustion chamber defined by a surrounding oven wall with partly overlapping rows of grate bars, wherein along the longitudinal axis the grate bar rows are arranged alternately fixed and movable and wherein the grate bar rows are bordered by grate side plates, the grate side plates being movable transverse to their longitudinal axes and pressable towards the grate bar rows by tensioning devices which are held in the oven wall and which are shaped as piston cylinder units, the invention further characterized in that each grate side plate (12, 13) is secured to a piston (7) of the tensioning device (3) and supported and guided only by the piston (7), the tensioning device (3) having a cylinder (4) open towards the combustion chamber and a hollow piston (7) guided therein, which is charged by a spring element (26), supported by the bottom (29) of the cylinder (4), the piston (7) being securely fastened to the grate side plate (12, 13) with a piston bottom (10) and being sealingly guided by a "piston sleeve" (8) located inside the cylinder (4).

2. The fire grate of claim 1, and further characterized in that the "piston sleeve" (8) has a length longer than the depth of the cylinder.

3. The fire grate of claim 1, and further characterized in that each of the pistons has a circular shape and a diameter which is greater than one half of the height of the grate side plate.

4. The fire grate of claim 1, and further characterized in that neighboring pistons (7) are flexibly connected with each other along their free ends by guiding bars (34).

5. The fire grate of claim 4, and further characterized in that a joint connection resides between the piston (7) and the guiding bar (34), including a joint bolt (36) oriented at a right angle to the longitudinal axis of the piston (7) and extending through the guiding bar (34), the joint bolt held by support tongues (35) which are rigidly held on the piston (7) and which hold the guiding bar (34) therebetween.

6. The fire grate of claim 1, and further characterized in that the cylinders (4) are mounted to the bottom (5) of an oven recess, or setback (2), so as to be recessed at a depth such that the grate side plates (12, 13) at the operating temperature of the grate bars are aligned with the oven wall (1).

7. The fire grate of claim 1, and further characterized in that each of the grate side plates has a double wall, including a carrying plate (12) connected to the piston (7) and a grate border plate (13) depending therefrom, the grate border plate (13) having ribs (38) extending toward the carrying plate (12) and oriented transverse to the longitudinal axis.

8. The fire grate of claim 7, and further characterized in that the grate border plate (13) has at least two plate parts arranged one next to another along the longitudinal direction of the carrying plate (12), the total length of the plate parts corresponding to the length of the carrying plate (12).

9. The fire grate according to the claim 1, and further characterized in that each of the grate side plates (12, 13) has a flange (17) along an upper edge thereof, the flange (17) extending toward the oven wall (1), and a covering ledge (21) fastened onto the oven wall above the flange (17).

10. The fire grate of claim 9, and further characterized in that an elastically yielding, seal (19) is fastened to the oven wall (1) between a free edge (18) of the flange (17) of the grate border plate (13), and the oven wall (1).

11. The fire grate of claim 10, and further characterized in that a bridge (37') is located along the backside of the carrying plate (12), the bridge (37') extending along the longitudinal axis and the bridge (37') extending sealingly into a groove (40) of the sealing volume (19').

12. The fire grate according to claim 9, and further characterized in that the covering ledge (21) includes a hollow space (23) which opens toward the flange (17), the hollow space (23) defined by an angle formed in the covering ledge (21).

13. The fire grate of claim 1, and further characterized in that the spring element (26) is adjustable in its tension.

* * * * *